US011564470B1

(12) United States Patent
Howard

(10) Patent No.: US 11,564,470 B1
(45) Date of Patent: Jan. 31, 2023

(54) SHOWER HEAD WITH RAZOR CLEANING CAVITY

(71) Applicant: Preston L. Howard, Hollywood, SC (US)

(72) Inventor: Preston L. Howard, Hollywood, SC (US)

( * ) Notice: Subject to any disclaimer, the term of this patent is extended or adjusted under 35 U.S.C. 154(b) by 366 days.

(21) Appl. No.: 16/841,336

(22) Filed: Apr. 6, 2020

Related U.S. Application Data

(60) Provisional application No. 62/829,379, filed on Apr. 4, 2019.

(51) Int. Cl.

| | |
|---|---|
| ***E03C 1/04*** | (2006.01) |
| ***A45D 27/46*** | (2006.01) |
| ***B05B 1/16*** | (2006.01) |
| ***B05B 1/18*** | (2006.01) |
| *E03C 1/02* | (2006.01) |

(52) U.S. Cl.
CPC ..... *A45D 27/46* (2013.01); *B05B 1/1636* (2013.01); *B05B 1/18* (2013.01); *B05B 1/185* (2013.01); *E03C 1/0408* (2013.01); *E03C 1/025* (2013.01)

(58) Field of Classification Search
CPC ..... A45D 27/46; B05B 1/1636; B05B 1/18; B05B 1/185; E03C 1/0408; E03C 1/025
See application file for complete search history.

(56) References Cited

U.S. PATENT DOCUMENTS

| | | | | |
|---|---|---|---|---|
| 3,396,462 | A | 8/1968 | Dufresne | |
| 4,480,387 | A | 11/1984 | d'Alayer de Costemore d'Arc | |
| 4,480,394 | A * | 11/1984 | Salas | A45D 27/46 219/242 |
| 4,838,949 | A | 6/1989 | Dugrot | |
| 5,365,958 | A | 11/1994 | Stuhlmacher, II | |
| 6,009,622 | A | 1/2000 | Liedblad | |
| 6,886,211 | B2 | 5/2005 | Severino | |
| 7,143,517 | B2 | 12/2006 | Kappes et al. | |
| 7,316,236 | B2 | 1/2008 | Hoser | |
| 9,439,494 | B2 | 9/2016 | Brady, Jr. | |
| 9,868,220 | B2 | 1/2018 | Moffat | |
| 9,914,154 | B2 | 3/2018 | Rabie | |
| 10,631,613 | B1 * | 4/2020 | Totonelly | A45D 27/46 |
| 2002/0145058 | A1 | 10/2002 | Tziviskos | |
| 2006/0283487 | A1 | 12/2006 | Grabowski | |
| 2008/0006311 | A1 | 1/2008 | Brown et al. | |
| 2008/0178480 | A1 * | 7/2008 | Inman | A45D 27/46 30/541 |
| 2014/0208601 | A1 | 7/2014 | Battin et al. | |
| 2017/0245616 | A1 | 8/2017 | Lakios et al. | |
| 2018/0192757 | A1 | 7/2018 | Lam | |

* cited by examiner

*Primary Examiner* — Qingzhang Zhou
(74) *Attorney, Agent, or Firm* — The Patent Professor

(57) ABSTRACT

A shower head including a razor cleaning cavity for jetting water onto the head of a razor, when inserted within the cavity, for removing hair cutting debris from between the blades of the razor while shaving. The shower head includes a spray head having a plurality of spray nozzles facing forward for showering, a razor cleaning cavity formed within the central region of the spray head and including a plurality of spray nozzles for cleaning between the blades of razor, a handle including a control valve for selectively diverting water out from the spray nozzles in front of the spray head or out from the spray nozzles in the razor cleaning cavity, a water delivery hose associated with the handle, and a holding bracket for holding the showerhead in pivoted positions.

20 Claims, 8 Drawing Sheets

SHOWER HEAD WITH RAZOR CLEANING CAVITY

CROSS-REFERENCE TO RELATED APPLICATIONS

This application claims the benefit of U.S. Provisional Patent Application Ser. No. 62/829,379, filed on Apr. 4, 2019, which is incorporated by reference herein in its entirety.

FIELD OF THE INVENTION

The present invention relates generally to shower heads, and more particularly, to a shower head including a razor cleaning cavity for selectively jetting water on the head of a razor for removing hair shaving debris from between the cutting blades of the razor when shaving.

BACKGROUND OF THE INVENTION

It is common for individuals to engage in the hygiene practice of shaving whether it involves a man shaving his beard or mustache, or a woman shaving her legs. There are various shaving devices available on the market today including electric razors or shavers having reciprocating or oscillating blades, and ultrasonic razors having vibration induced blades to assist in shaving. A more common razor used by many includes disposable or safety razors, or razors having disposable cartridges, Such razors generally include a handle and a razor head or cartridge attachment to the end of the handle. Many companies market the advantage of using disposable razors that have a plurality of cutting blades for providing a closer, smooth shave. Most disposable razors generally include anywhere between one and five cutting blades provided on the head of the razor, or cartridges that include a plurality of blades where the blades are arranged in a step configuration forming small passages between each blade to allow hair shaving debris to exit through the small passages. Shaving gels, foams, or creams are often used to condition the hair and skin of the shaver and reduce frictional contact of the blades on the user's skin to provide a comfortable shave.

Shaving often occurs throughout various places of the home, either in the bathtub, in the shower, or near a sink. For example, in considering the ways that men and woman shave, some men shave in the shower, or stand in front of the sink to typically view the shaving progress in a mirror. Woman often shave their legs in the shower with their feet on the shower floor, resting on the perimeter of the tub, or on a seat provided within the shower. During the course of shaving, loose hair often mingles with the shaving cream to form a residue lodged between the small passages of the razor blades. The build-up of residue typically occurs after making several shaving strokes. To retain the adequate function of the razor, users must constantly clean the razor blades while shaving. Various methods are employed by users in an attempt to clean the razor blades, for example, users often place the head of the razor under the water faucet, or under the shower head, to direct the flow of water over the razor blades to force out hair shaving residue. In doing so, users often hold the head of the razor under the faucet and shake the razor vigorously numerous times in an effort to force the cut hair and shaving cream out from between the blades. In conjunction with rinsing the razor, users also rap the head of the razor on the bottom or edge of the sink or shower to provide a jolted force to further dislodge any debris remaining between the razor blades. Still other users will submerge the head of the razor into a sink of water, or receptacle full of cleaning solution, and shake or swish the razor back and forth numerous times for the liquid to pass between the blades to flush out the hair debris. Such cleaning methods are used repeatedly throughout the course of shaving but provides a particular slow and poor job at removing hair from between the razor blades. On many occasions, the remaining hair residue is tightly jammed between the razor blades requiring a stronger force of water, or further rapping of the razor head on a surface. Many individuals do not take the time necessary to completely remove the cut hair from the blades, and thus, any residue remaining between the blades hardens over time as it dries making more difficult to clean between the blades.

Conventional razor cleaning devices or systems are provided to better assist individuals in removing hair shaving debris from between razor blades during or after use. For example, some devices generally include a funnel or scoop that is attached directly to the spout of a faucet, or to the head of the razor, for directing water over the blades of the razor to dislodge any shaving debris lodged between the razor blades. More sophisticated razor cleaning devices generally include a container having a reservoir for holding a cleaning solution therein, and an electricity or battery operated transducer, pump, or spray jet device, for circulating or spraying cleaning solution pass the head of the razor when the head of razor is disposed within the cleaning solution of the reservoir. Many razor cleaning devices have added features such as timers for setting time and length of cleaning, status indicators as to when to change the cleaning solution, include radio and/or clock features, and ultraviolet radiation sources to clean the surface of the blades for sanitary, or disinfectant purposes. Although such prior art devices provide some assistance in cleaning razor blades of disposable or safety razors, or blades provided on disposable cartridges, such devices are either, cumbersome to use while shaving, or comprise stand-alone units that are placed on a counter and used for cleaning razor blades after the user has finished shaving. The prior art razor cleaning devices, such as scoops, or reservoir filled cleaning solutions, do not allow users to effectively use such devices, or clean the razor blades of a razor, effectively while in the process of shaving or showering.

There is often a desire, whether to save time, or simply for added convenience, to shave while taking a shower. The conventional shower head provides a water spray for washing the body and is also used to quickly rinses any shaving cream, soap, or hair-shaving debris remaining on the body. Most shower heads include a handheld shower head including a plurality of spray apertures, a hose connected to the shower head for delivering water to the plurality of spray apertures, and a bracket for holding the shower head in place. Users have the option of retaining the shower head within the holding bracket, or alternatively, holding the shower head in hand when showering. Most shower heads include a rotating head for allowing users to adjust both the pattern and pressure of water exiting from the spray apertures of the shower head. When shaving in a shower, users typically hold the head of a razor in close proximity to the spray apertures of the shower head in hopes of projecting water directly onto the blades of a razor to flush out any hair-shaving debris from between the blades. On many occasions, users orient the head of the razor in different positions, while under the show head, to align the water spray between the blades to remove hair shaving debris, a process which is repeated over and over again while shaving in the shower. Users often adjust the rotating head to increase water pressure or flow in an effort to increase the force of water to adequately clean the razor blades. As such, conventional shower heads do not provide a prescribed means of effectively cleaning razor blades of a razor leaving users to resort to other cumbersome methods of cleaning the razor blades. Also, many individuals do not take the time needed to adequately clean the razor blades, and simply replace existing razor blade cartridges, or disposable razors with new ones leading to increase costs.

Accordingly, there is an established need for solving some of the aforementioned problems by providing a shower head including a razor cleaning cavity and spray control for selectively jetting water onto the head or cartridge of a razor, removably inserted within the razor cleaning cavity, to clean the blades of the razor, or to flow from the shower head for showering.

SUMMARY OF THE INVENTION

The present invention is directed to a showerhead including a razor cleaning cavity provided within the central region of the shower head for jetting water onto the head of a razor for removing hair cutting debris from between the blades of the razor while shaving. A control valve allows users to selectively divert water out from the showerhead when showering, or out from the razor cleaning cavity to clean the blades of a razor.

A first embodiment of the invention provides a shower head having a razor cleaning cavity, said shower head comprising a spray head including: a front member including a central cavity having an opening and an inner circular wall, and a planar front surface surrounding the central cavity, the inner circular wall and the planar front surface including a plurality of holes; a back member including a plurality of apertures, and a drain cover disposed over the plurality of apertures defining a drain channel; a plurality of spray nozzles extending from the plurality of holes in both the planar front surface, and the inner circular wall; a first peripheral channel in fluid communication with the plurality of spray nozzles on the front surface; a second peripheral channel in fluid communication with the plurality of spray nozzles in the inner circular wall, where the front member is attached to the back member enclosing the peripheral channels and disposing the plurality of apertures at a closed end of the central cavity; a handle housing a diverter valve assembly including an inlet port, a rotating diverter plate associated with a stem, a first supply conduit in fluid communication with the first peripheral channel, and a second supply conduit in fluid communication with the second peripheral channel, one end of the stem extending through a front wall of the handle and coupled to a control knob for operating the diverter plate, where the spray head is attached to one end the handle; a hose having one end removably attached to one end of the inlet port, and another end removably attachable to a water delivery fixture; and wherein the diverter valve is selectively operated to allow water to flow out from either the plurality of spray nozzles on the front surface of the spray head, or to flow out from the plurality of spray nozzles within the razor cleaning cavity.

In a second aspect, the plurality of spray nozzles extend forward from the spray head to deliver water onto a person when showering, and the plurality of spray nozzles provided within the cleaning cavity are arranged perpendicular pointing to each other, to direct water towards the central region of the cleaning cavity.

In another aspect, the diverter valve comprises a rotating valve that is rotated in a first position so that the diverter plate prevents water from flowing through the first supply conduit, and within the first peripheral channel and out from the plurality of spray nozzles provided on the planar front surface of the spray head, but allows water to flow through the second supply conduit within the second peripheral channel and out from the plurality of spray nozzles provided within the central cavity.

In still another aspect, the diverter valve comprises a rotating valve that is rotated in a second position so that the diverter plate prevents water from flowing through the second supply conduit and within the second peripheral channel and out from the plurality of spray nozzles provided in the central cavity, but allows water to flow through the first supply conduit within the first peripheral channel and out from the plurality of spray nozzles provided on the planar front surface of the spray head.

In another aspect, the opening of the central cavity includes a rounded entrance perimeter allowing users to maneuver the handle of a razor in various angles to orient the head of the razor within the cavity in various positions allowing water that is ejected from the spray nozzles in the cavity to effectively flush hair cutting debris from between the blades of the razor.

In yet another aspect, the shower head includes a holding bracket having an extended member including a water inlet attachable to a water delivery fixture, a water outlet for removable attachment of one end of the delivery hose, and a pair of arms extending from the member and spaced apart to form a cradle for removably inserting and holding the handle of the shower head.

In another aspect, the holding bracket includes a ball and socket, tooth clamp arrangement, or other lockable pivot arrangement or mechanism that is operated to pivotably hold the shower head in various positions.

In yet another aspect, the control knob may include a rotating knob, a slide member, a toggle mechanism, an electric operator, or a push button.

In another aspect, the handle of the shower head may include ridges, indentations, nubs, raised surfaces, or a friction material to prevent the handle from slipping when holding the handle during use.

In yet another aspect, the drain cover includes one end attached to a back surface of the back member adjacent the plurality of apertures and an opposite end detached and free from the hack surface of the back member to define the drain channel where excess water in the razor cleaning cavity exits from the plurality of apertures and through the drain channel behind the shower head.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed to a shower head including a razor cleaning cavity provided within the central region of the shower head for removing hair cutting debris from between the blades of the razor while shaving. A control valve allows users to selectively divert water out from the shower head when showering, or out from the razor cleaning cavity to jet water onto the blades of a razor for flushing hair cutting debris from the blades.

Figure 1:
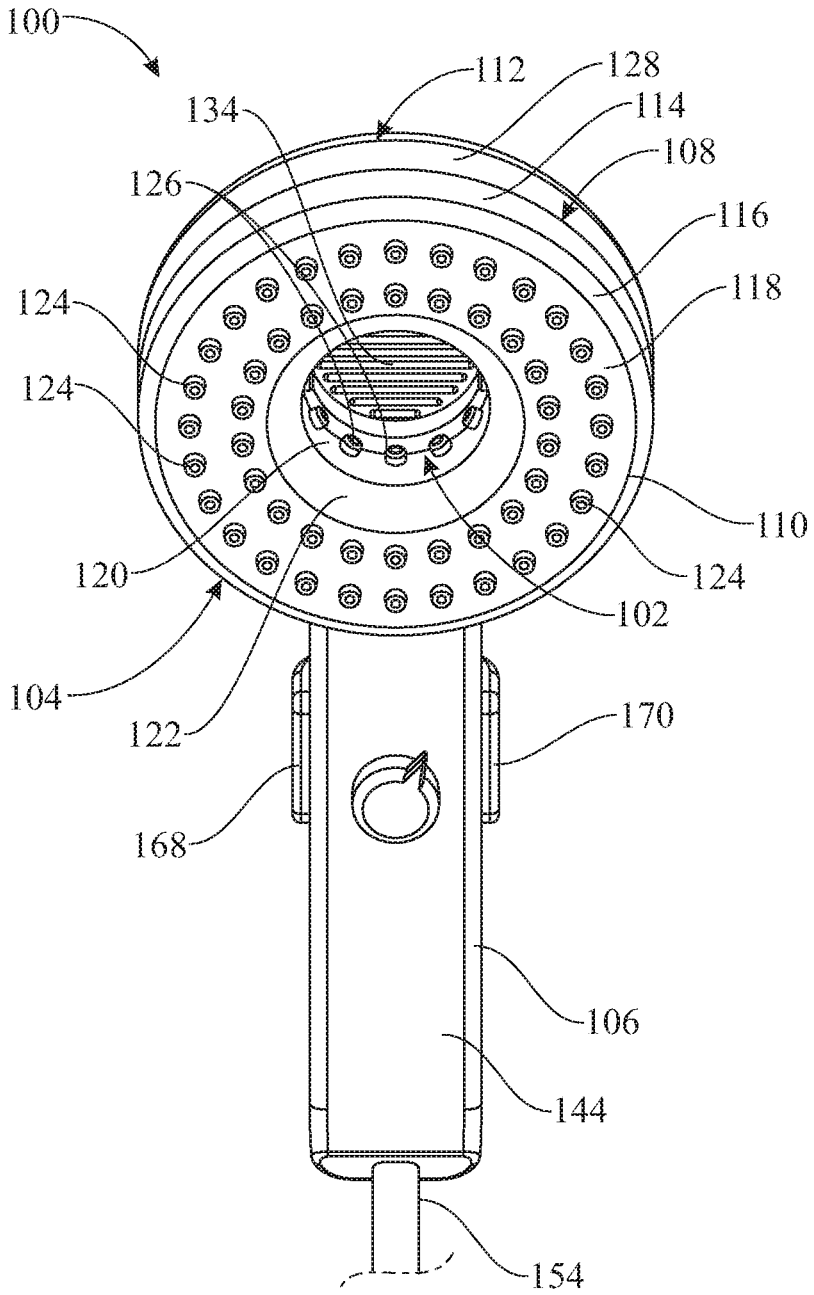
FIG. 1 is a front view of a shower head including a razor cleaning cavity, showing a plurality of spray nozzles disposed on the front planar surface of the shower head, and within the razor cleaning cavity, a handle including a diverter valve control knob, water drains provided in the back member of the razor cleaning cavity, and a partial view of a water delivery hose in fluid communication with the plurality of spray nozzles, in accordance with an embodiment of the present invention.
Figure 6:
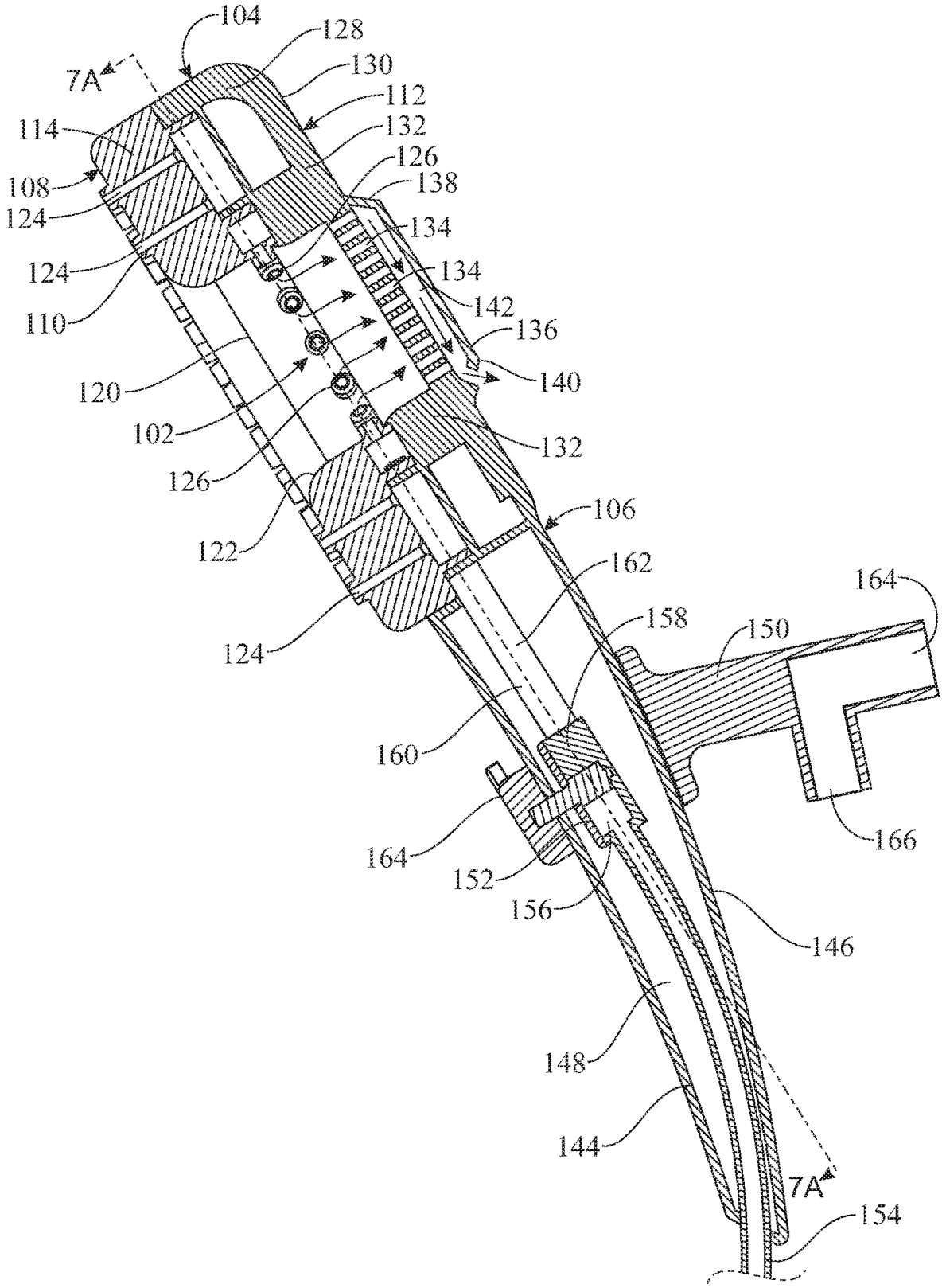
FIG. 6 is a side, cross-sectional view of the shower head including a razor cleaning cavity, showing the directional flow of water exiting the razor cleaning cavity through draining apertures and out of a drain channel provided on the back member of the shower head, in accordance with another embodiment of the present invention.

Referring now to the drawings wherein like elements are represented by like numerals throughout, there are shown in FIGS. 1 and 6, a front, and side, cross-sectional view, respectively, of a handheld shower head 100 including a central razor cleaning cavity 102, in accordance with an embodiment of the present invention. The shower head 100 includes a spray head 104 provided at the distal end of a handle 106 that is ergonomically designed for easily grasping and holding shower head 100 during use. The spray head 104 includes a front member 108, a nozzle assembly 110, and a back member 112 permanently or removably attached to the front member 108. The front member 108 comprises an outer circular wall 114 having a predetermined height that is integrally attached to a beveled section 116, and terminates along a front planar surface 118. An opening is provided within the central region of the front member 108 forming a front central hub 120 including an inner circular wall having a predetermined depth, an open top, an open bottom, and a rounded or beveled peripheral entrance 122 similar to entry of a donut hole. The formation of the front central hub 120 defines part of a central razor cleaning cavity 102 for accommodating the cartridge or head of a razor 200. In one embodiment, the front member 108 may be injection molded or extruded as a single piece having a central opening forming an inner circular wall or hub, having a predefined depth. In another embodiment, the front central hub 120 may include a plurality of cylindrical pieces, that have the same diameter as the central opening, and are joined together and aligned with the central opening to define a front hub having a desired depth defined by the joined cylindrical pieces.

The nozzle assembly 110 includes a plurality of water spray nozzles 124 formed in the front planar surface 118 of the front member 108, and arranged to jet water outwards towards a person when taking a shower. The diametrical size of each spray nozzle 124 is designed to permit water to jet out at a predetermined force or pressure, and may comprise any number of nozzles that are oriented in any fashion or configuration on the outer planar surface 118 of the front member 108. In one exemplary embodiment, the spray nozzles 124 are disposed in a peripheral orientation forming concentric circles. However, the spray nozzles 124 may be disposed in any variation, layout, or orientation on the outer surface 118 of the front member 108. Each spray nozzle 124 may comprise any of, channels or apertures that are formed through the body of the front member 108, or include rubber, plastic, or metal nozzle extensions or ports extending from, or associated with, corresponding spray holes. It will be understood that in another embodiment, the spray head 104 may include a mechanical or electrical system to allow users to adjust both the pattern, or delivery pressure of water ejecting from the spray nozzles 124. For example, a rotating disc or valve system can be implemented to provide a spray pattern, a trickle pattern, a power spray pattern, a messaging force, or any combination thereof.

The nozzle assembly 110 also includes a plurality of water spray nozzles 126 provided on, or formed within, the inner wall or hub 120 of the razor cleaning cavity 102. As illustrated in both FIGS. 1 and 6, the spray nozzles 126 are oriented perpendicular within the cavity 102 to direct water towards the central region of the cavity 102 to effectively force or flush out hair cutting debris from between the razor blades of a razor 200 when inserted within the cavity 102. Each spray nozzle 126 may comprise the same or different size, or include a combination of different sizes to efficiently spray water at the same, or different threes or pressures. Also, the plurality of spray nozzles 126 may be the same or different from, the plurality of spray nozzles 124 provided on the outer planar surface 118 of the front member 108. In one embodiment, the spray nozzles 126 may be adjustable, via an adjustment mechanism (not shown), to adjust the pressure, or directional flow, of water ejecting from the spray nozzles 126 and oriented at the same or different angles within the razor cleaning cavity 102. Also, any number of spray nozzles 126 can be provided within the razor cleaning cavity 102, and comprise a singular spray pattern, or a combination of different spray patterns.

The back member 112 generally comprises a body having a geometrical shape that corresponds in shape and size of the front member 108 and includes a surrounding cylindrical wall 128 that is integrally formed with a back panel 130. The back member 112 is attached to the front member 108 such that the outer surface of each surrounding wall 114, 128 is coplanar with each other forming a shower head having main surrounding wall. The back member 112 is permanently or releasably attached to the front member 108 using any well-known water proof adhesive, fastener, interlocking detents formed within the body of each the front and back member, or by ultrasonic plastic welding. In one embodiment, the back member 112 includes a back central hub 132 defined by a circular wall integrally formed with the inner surface of the back panel 130, and having an opening. When the back member 112 is attached to the front member 108, the back central hub 132 aligns and engages with the front central hub 120 of the front member 108 so that the bottom opening of the front central hub 120 correspondingly aligns with the opening for the back central hub 132 defining a razor cleaning cavity 102 having a back panel 130. Thus, it will be understood that the diameter and depth of the razor cleaning cavity 102 is defined by the diameter and depth of each central hub 120 and 132. As such, a spray head 104 may include a razor cleaning cavity 102 having different diameters, and/or depths. It will also be understood that the razor cleaning cavity 102 may comprise any geometrical size and shape including for example, a square, oval, or rectangular geometric shape, and may be located or provided in or on any part of the spray head 104.

With continued reference to FIG. 6, a plurality of water drain holes 134 are provided through the body of the back panel 130 allowing water to drain out from the razor cleaning cavity 102 during and after use of the device to promote drying. Each drain hole 134 is sized to efficiently allow water to pass through with ease preventing water from accumulating within the razor cleaning cavity 102. A drain shield 136 is disposed over the drain holes 134 for water to hit the inner surface of the shield 136 and drain outwards and away from the back of the spray head 104 preventing drainage water from spraying out sporadically into the air. The drain cover 136, generally comprises a plastic or metal plate having a selected width, length and thickness with one end attached to the back surface 130 of the back member 112 via, an angle extension 138, and an opposite end 140 openly detached and free from the back panel 130 forming a drain channel 142 to direct the flow of drainage water outwards and away from the spray head 104, as denoted by directional arrows.

The handle 106 generally includes a front wall 144 integrally formed with, or separately attached to, a back wall 146 defining an inner chamber 148. In one embodiment, the back wall 146 includes a curvature or a curved configuration to enable a downward positioning of the spray head 104 when the shower head 100 is placed in a holding bracket 150 within the shower. The curved configuration of the back wall 146 also promotes directional flow of water towards users when holding in hand and maneuvering the shower head around the body during use. The inner chamber 148 is adapted to house a water diverter valve 152, and includes a bottom opening for receiving a distal end of a water delivery hose 154. The handle 106 may, include any width, and length, and may include friction enhancing materials, indentations, stubs, ridges, or the like to prevent the handle 106 from slipping through a user's hand during use.

Figure 8:
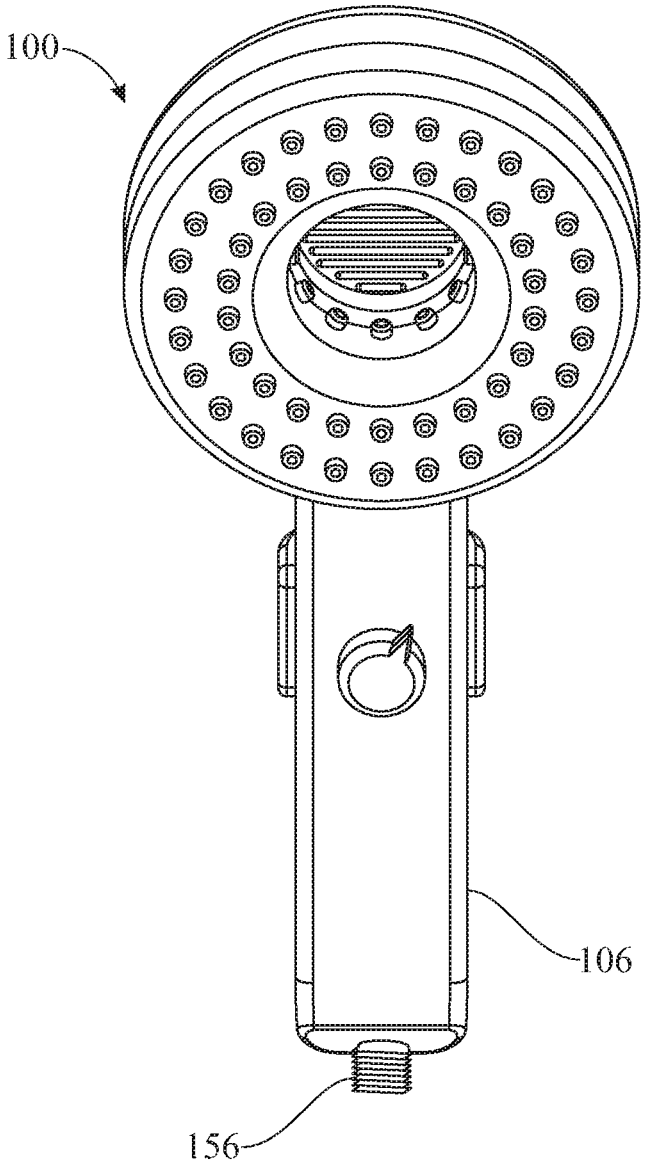
FIG. 8 is a front view of a shower head showing a handle having an inlet port disposed externally at the bottom thereof, in accordance with an embodiment of the present invention.

The shower head 100 includes a diverter valve 152 for selectively directing water out from the plurality of spray nozzles 124, 126 located on the front member 118, or in the razor cleaning cavity 102, respectively. In one embodiment, the water diverter valve 152 generally includes a valve body comprising an inlet port 156, a rotatable diverter plate 158 attached to the lower bottom section of a stem, water delivery conduits 160, 162 in fluid communication with the delivery tube 154, and a control knob 164. In at least one embodiment, such as is shown in FIG. 8, the shower head 100 includes an inlet port 156 disposed externally of the handle 106 at the bottom thereof. The handle 106 also includes a small aperture formed through the front wall 144 to receive a portion of the stem of the valve 152 so as to affix a control knob 164 to the tip of the stem for operating the diverter plate 158. In one embodiment, the control knob 164 is provided, on the handle 106, in a thumb or finger accessible range for users to hold the handle 106 in one hand, and maneuver the control knob 164 with ease. It will be understood that other types of controls may be used to operate the diverter plate 158, including but not limited to, a push button, slide switch, toggle switch, or other suitable control. The diverter valve 152 including the diverter plate 158, delivery ports 160, 162 and control knob 164 may be constructed from any durable material including any of plastic, or a water-resistant metal, such as stainless steel, brass, or other galvanized metal. The control knob 164 may comprise the same or different color from that of the handle 106.

The hose 154 includes one end that is permanently, or removably, coupled to the inlet port 156 of the diverter valve 152, and another end that is coupled to an outlet 166 of a holding bracket 150 that is readily attachable to the end of a shower pipe. The hose 154 is designed to deliver water to the inlet port 156 and selectively divert water through a first conduit 160, or through a second conduit 162. In one embodiment, the hose 154 comprises any well-known shower hose currently available on the market today. In another embodiment, the hose 154 is generally constructed from any of plastic, plated stainless steel, PVC flexible material, or stainless steel, or brass material. In another embodiment, the hose 154 may include an attachment device such as a clamp, twist-lock connector, bayonet connector, spring detent connector, or coupling, adapted for removable attachment to either the inlet port 156 of the diverter valve 152, and/or to the outlet 166 of the holding bracket 150. The hose 154 may comprise any color selected to match with the spray head 104, the handle 106, or with existing bath fixtures.

The shower head 100 is removably attachable to a holding bracket 150 that is mountable on the end of a shower pipe generally provided in shower stalls, or to an end of a faucet or other water delivery fixture. The holding bracket 150 includes a water inlet 164 having a plurality of threads formed on the inner surface of the inlet for threading the bracket onto the end of the shower pipe, and a water outlet 166 for releasable connection to the hose 154 for delivering water to the shower head under pressure. The holding bracket 150 includes a pair of holding arms 168, 170, as better illustrated in FIG. 1 for holding the shower head 100 in either a permanent position, or in different pivoted positions. Each holding arm 168, 170 includes one end attached to, or integrally formed with, the holding bracket extension, and other ends disposed in parallel, and spaced apart a predetermined distance from each other, forming a cradle for holding the handle 106 of the shower head 100 therein. In one embodiment, each arm 168, 170 may include a friction material to firmly grip the handle 106 of the shower head when the handle 106 is inserted within the holding bracket 150. In one non-limiting embodiment, the holding bracket 150 may include a ball and socket configuration to pivot the shower head 100 about an axis allowing users to adjust the spraying angle of the shower head when secured within the holding bracket 150. The ball and socket arrangement may include an adjustable detent, or tightening collar or clamp to lock the shower head 100 into a variety of different pivoted positions. In one alternative embodiment, the distal end of the hose 154 is releasably attached to the spout of a faucet or sink, rather than to a shower pipe in a shower stall, allowing individuals to use the shower head 100 in a variety of places. Thus, individuals may wish to use the shower head 100 near a sink or faucet rather than in a shower or bath, giving individuals the option of using the razor cleaning cavity 102 near a sink, basin, or around a faucet that is not associated with a shower. An added convenience provides a shower head 100 including one or more suction cups that is permanently or removably attached to the back member 130, or handle 106 to conveniently attach the shower head 100 to any surface allowing portable use of the shower head and a razor cleaning cavity 100. In one example, the shower head 100 may be stored within luggage and retrieved in a hotel for use when shaving either in a shower or at a sink. The suction cups can hold the shower head 100 in proximity to the sink or shower basin during use. It is appreciated that the shower head 100 may be used as the primary shower head that replaces an already existing shower head via, the holding bracket 150, or a stem "T", or alternatively, is used separately from but in addition to the main shower head where the shower head 100 is attachable to a surface using one or more suction cups.

Figure 7A:
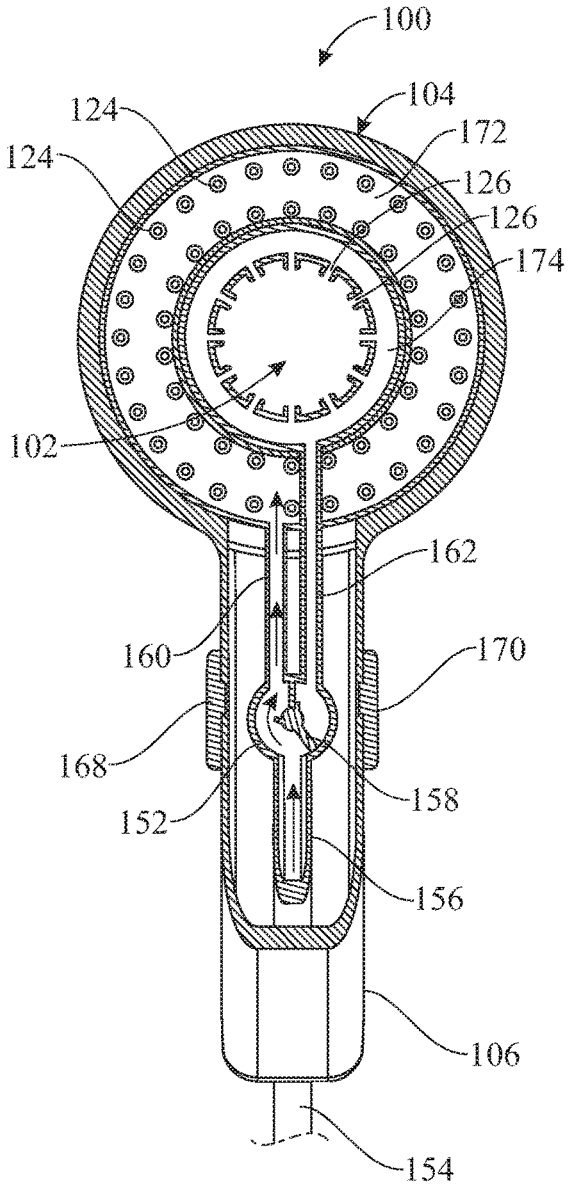
FIGS. 7A and 7B, are front, partial, cross-sectional views of the shower head including a razor cleaning cavity, showing the operative position of a water diverter knob for selectively diverting water, supplied by a water delivery hose, to the plurality of spray nozzles provided on the front surface of the shower head, or alternatively, to the plurality of spray nozzles provided within the razor cleaning cavity for cleaning the razor blades of a razor when inserted within the razor cleaning cavity, in accordance with an embodiment of the present invention.
Figure 7B:
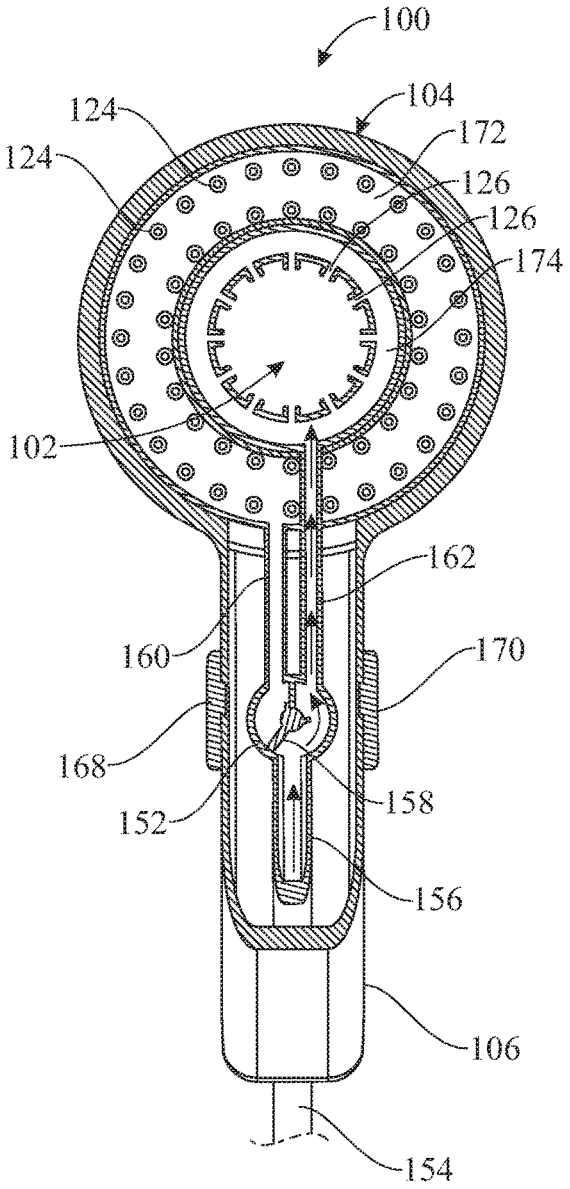

Turning to FIGS. 7A and 7B there are shown a front, partial, cross-section view, of the shower head 100, illustrating directional flow of water to a plurality of spray nozzles 124, 126 provided on and in the shower head 100, in accordance with the present invention. Nozzle assembly 110 includes a first peripheral channel 172 in fluid communication with both the plurality of water spray nozzles 124 provided on the front outer surface 118, and the first conduit 160 extending from the body of the diverter valve 152. The first peripheral channel 172 is defined by a space formed between the outer circular wall of the spray head 104, and an inner peripheral wall. As shown in FIG. 7A, the diverter valve 152 is rotated, via the control knob 164, as seen in FIG. 1, to position the diverter plate 158 of the valve 152 between the inlet port 156 and the cavity conduit 162 preventing water from flowing within the cavity conduit 162 and out the plurality of spray nozzles 126, and diverting water to flow within the first conduit 160 and out from the plurality of spray nozzles 124 on the front end 118 of the spray head 104. A second peripheral channel 174 is also provided within the nozzle assembly 110 and is in fluid communication with the plurality of water spray nozzles 126 provided in the razor cleaning cavity 102, and with a second cavity conduit 162 extending from the diverter valve 152. The second peripheral channel 174 is defined by a space formed between the inner peripheral wall and the plurality of spray nozzles 126. As shown in FIG. 7B, the diverter valve 152 is rotated, via the control knob 164, as seen in FIG. 1, to position the diverter plate 158 between the inlet port 156 and the first conduit 160 preventing water from flowing within the conduit 160, and out the plurality of spray nozzles 124, and diverting water to flow within conduit 162 and out from the plurality of spray nozzles 126 provided within the razor cleaning cavity 102. As such, it is seen that each peripheral channel 172, 174 selectively receives a supply of water delivered by the hose 154 to selectively direct water out from the plurality of spray nozzles 124, 126 under pressure, via, diverter valve 152. It will be understood that selective delivery of water through the plurality of spray nozzles 124, 126 may include a diverter valve 152 that is designed to allow for three positions, where in one position the diverter valve 152 directs water through a plurality of spray nozzles 124 on the spray head 104 and prevents water from flowing through spray nozzles 126 in the razor cleaning cavity 102, placing the diverter valve 152 in a second position to prevent water from flowing through the spray nozzles 124, but allowing water to flow out from the spray nozzles 126 of the razor cleaning cavity 102, or placing the diverter valve 152 in a third position to allow water to flow out from both plurality of spray nozzles 124, 126 at the same time, if desired. Also, rotational control of the control knob 164 and diverter plate 158 may comprise a variety of different operational configurations such that rotating the control knob 164 clockwise forces the diverter plate 158 to rotate either in a clockwise direction, or alternatively in a counter-clockwise direction.

Figure 2:
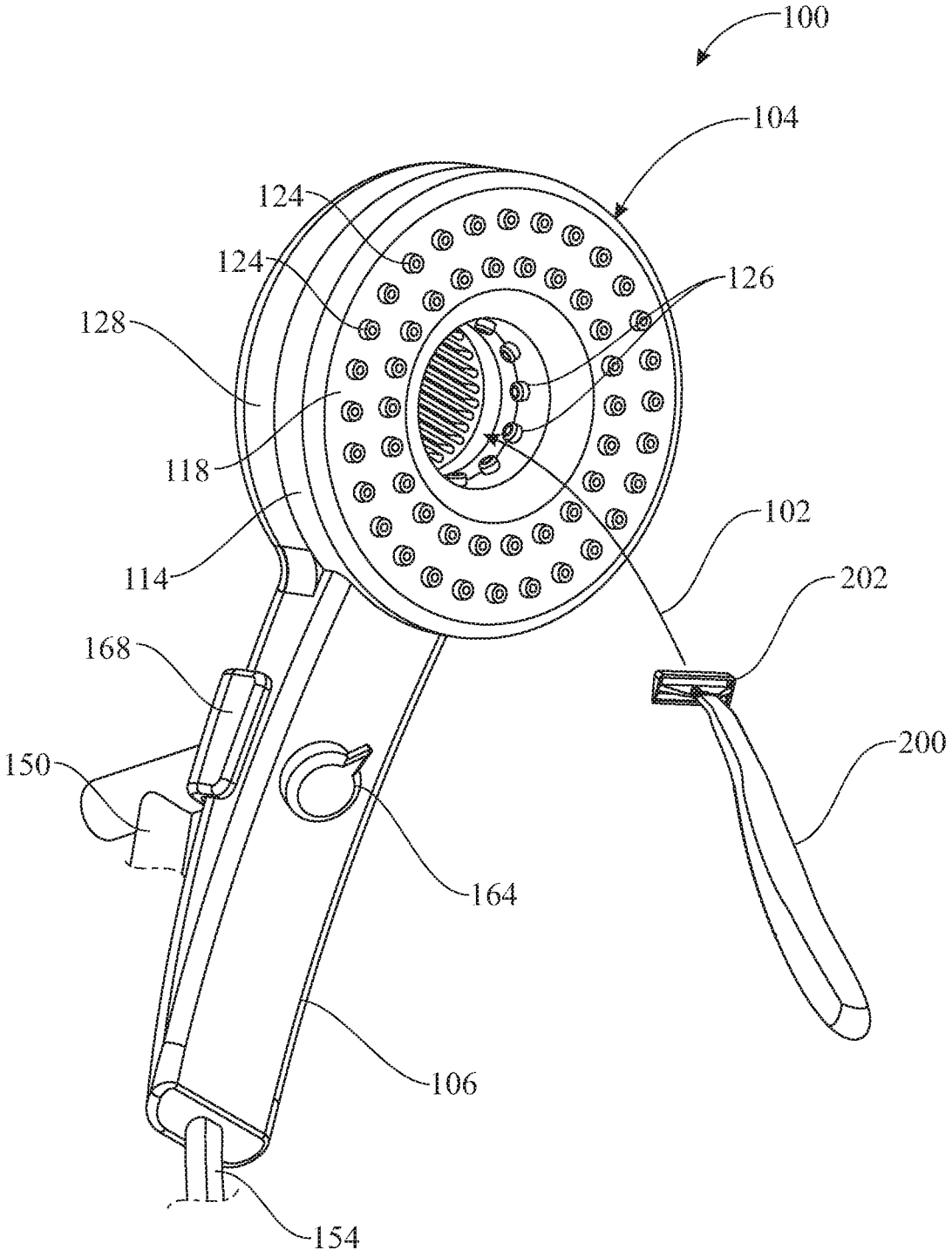
FIG. 2 is a front, perspective view of the shower head including the razor cleaning cavity of FIG. 1, showing a razor readily insertable within the razor cleaning cavity for selective cleaning of the razor blades, and a holding bracket for holding the handle of the shower head in pivoted positions, in accordance with an embodiment of the present invention.
Figure 3:
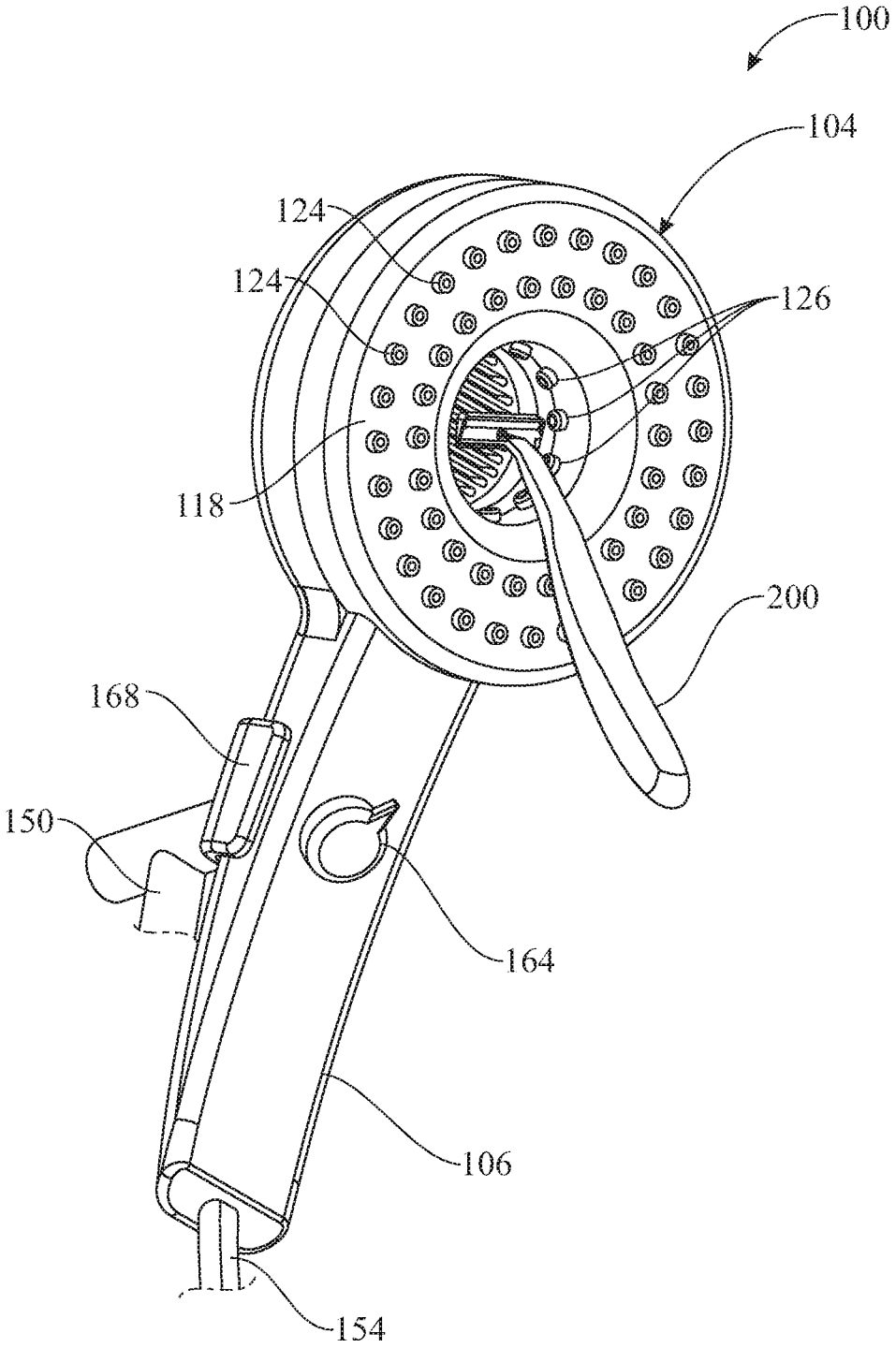
FIG. 3 is a front, perspective view of the shower head including a razor cleaning cavity of FIG. 2, showing the head of a razor removably inserted within the razor cleaning cavity for readily cleaning the blades of the razor, in accordance with the embodiment of the present invention.

Referring now to FIGS. 2 and 3, there are shown front, perspective views, of a shower head including a razor cavity 100 showing the head 202 of a razor 200 readily inserted, within the razor cleaning cavity 102, in accordance with an embodiment of the present invention. While an individual is shaving, whether in the shower, or at a sink, there is need to remove the hair cutting debris between the blades of a razor provided on a razor head 202, or a razor blade cartridge. In doing so, the person places the head 202 of the razor 200 directly within the central region of the razor cleaning cavity 102 while aligning the razor blades with the plurality of spray nozzles 126. The rounded entrance 122, provided around the perimeter of the cavity 102, allows users to move the handle of the razor 200 in various angles to orient the head 202 of the razor 200 in different angles and positions within the cavity 102 and properly align the blades of the razor 200 with the plurality of spray nozzles 126 to remove hair cutting debris from between the razor blades.

Figure 4:
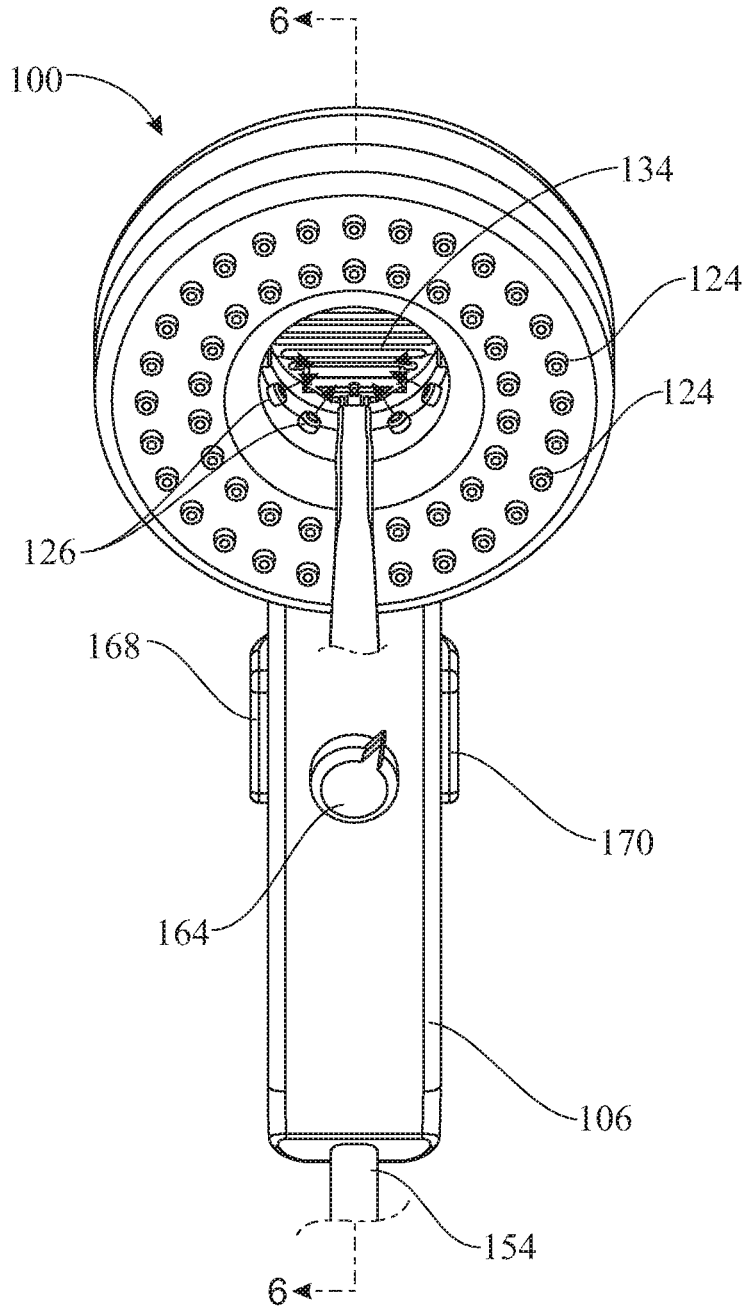
FIG. 4, is a front view of the shower head including a razor cleaning cavity, showing the head of a razor removably inserted within the razor cleaning cavity, and the water diverter knob rotated in a first position to selectively divert water out from the plurality of spray nozzles provided within the cavity and towards the razor blades of the razor to remove shaving hair debris from between the razor blades, in accordance with an embodiment of the present invention.

Upon readily positioning the head 202 of a razor 200 within the razor cleaning cavity 102, the user rotates the control knob 164 to selectively divert water through the plurality of spray nozzles 126 and eject the water onto the head 202 of the razor 200 to remove hair cutting debris from between the blades of the razor 200 by force of the water, as shown in FIG. 4. The control knob 164 of the diverter valve 152 is rotated to position the diverter plate 158 between the inlet port 156 and the spray conduit 160 preventing water from flowing within the spray conduit 160, and out from the plurality of spray nozzles 124, and diverting the water to flow within the conduit 162 and out from the plurality of spray nozzles 126 provided within the razor cleaning cavity 102, as illustrated in FIG. 7B.

Figure 5:
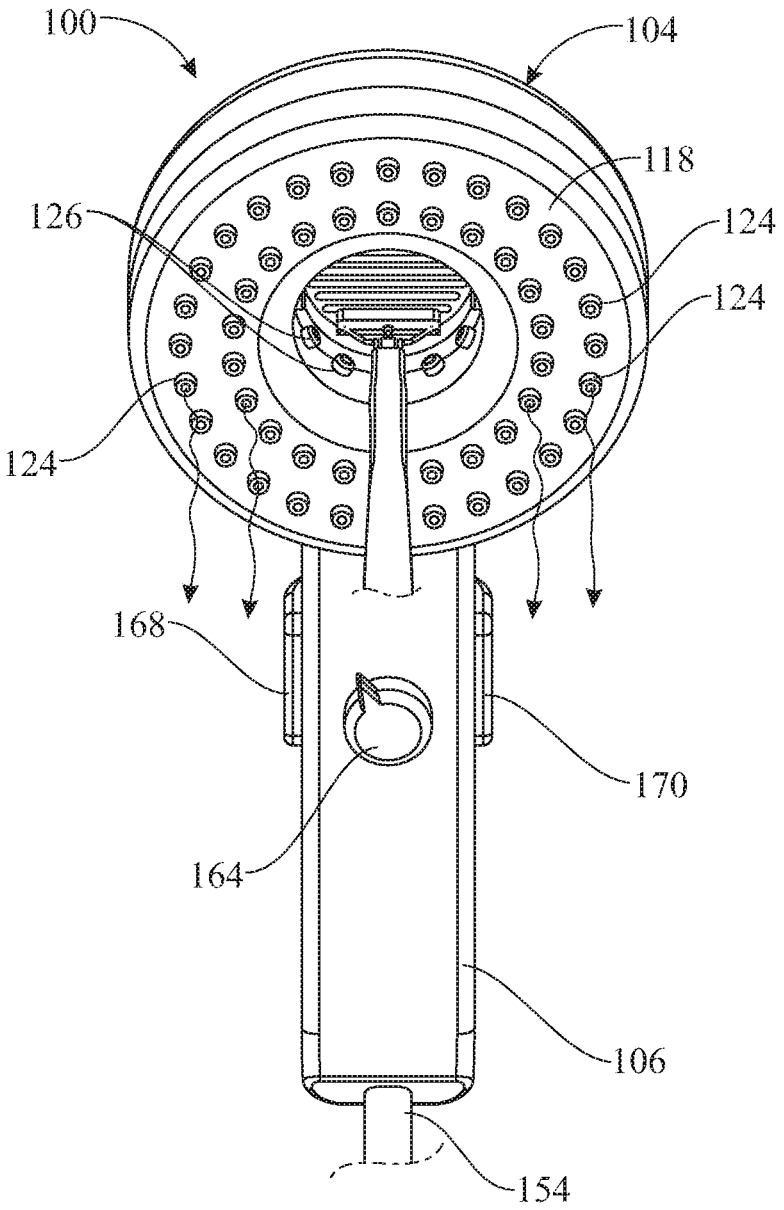
FIG. 5, is a front view of the shower head including a razor cleaning cavity, showing the water diverter knob rotated in a second position to interrupt the flow of water ejecting from the plurality of spray nozzles in the razor cleaning cavity, and divert water to flow out from the plurality of spray nozzles provided on the front of the shower head, in accordance with an embodiment of the present invention.

As illustrated in FIG. 5, users may opt to use the spray nozzles 124 in the front of the spray head 104 for showering, or for rinsing shaving cream or other debris from the body. In doing so, the user rotates the control knob 164 to selectively direct water through the plurality of spray nozzles 124 on the front surface 118 of the spray head 104 and into the shower stall, as shown in FIG. 5. The control knob 164 of the diverter valve 152 is rotated to position the diverter plate 158 between the inlet port 156 and the cavity conduit 162 preventing water from flowing through the conduit 162, and out from the plurality of spray nozzles 126, and diverting water to flow within the spray conduit 160 and out from the plurality of spray nozzles 124 of the spray head 104, as illustrated in FIG. 7A. As noted earlier, an embodiment may allow users to operate the control knob 164 to allow water to flow from both plurality of spray nozzles 124, 126 at the same time.

The shower head 100 includes a razor cleaning cavity 102 that is designed to clean razor blades of razors quickly, more efficiently, and with much less effort when shaving. Compact in design, it makes shaving, with a bladed razor, much easier and safer than using traditional methods or conventional devices for cleaning razor blades. The shower head including a razor cleaning cavity 100 can be installed onto the end of any water delivery fixture such as at the end of a shower pipe or faucet, and can be permanently or removably installed to provide for a portable device for use anywhere. For example, a woman shaving her legs could mount the shower head including razor cleaning cavity 100 in any convenient location in close proximity to her body to make cleaning the razor blades easier and faster for her when shaving. The shower head 100 is easily mounted onto existing shower tee connections generally located on the shower neck, as such the shower head 100 can replace existing shower heads with ease and convenience.

The shower head including razor cleaning cavity 100 can be engineered and designed to accommodate specific brands of men's and women's razors having razor blade heads or razor blade cartridges comprising different sizes and/or shapes. Further, the shower head 100 may include aesthetic indicia, patterns, or designs, come in a range of different colors, styles, or popular finishes such as chrome, bronze, brushed chrome, white, ivory, or other colors. A detachable razor holder may be incorporated for holding one or more razors, and various hygiene accessories may be included with, or sold separately from, the shower head 100.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A shower head having a razor cleaning cavity for cleaning one or more blades in a head of a razor, said shower head comprising:

a spray head having a front surface disposed around a central razor cleaning cavity which is at least partially defined by an inner wall, said central razor cleaning cavity dimensioned and configured to receive at least a portion of the head of the razor therein for cleaning;

each of said front surface and said inner wall including a plurality of holes formed there through;

a plurality of spray nozzles each corresponding to one of said plurality of holes through said front surface and said inner wall and disposed thereon, respectively;

a first peripheral channel in fluid communication with said plurality of spray nozzles on said front surface;

a second peripheral channel in fluid communication with said plurality of spray nozzles on said inner wall; and a handle having said spray head mounted at one end thereof, said handle comprising a diverter valve assembly selectively operable to allow water to discharge either from said plurality of spray nozzles on said front surface, or from said plurality of spray nozzles on said inner wall so as to clean the one or more blades in the head of the razor positioned therein for cleaning.

2. The shower head having a razor cleaning cavity as recited in claim 1 wherein each of said plurality of spray nozzles disposed on said front surface of said spray head is positioned to deliver water onto a person while showering.

3. The shower head having a razor cleaning cavity as recited in claim 1 wherein each of said plurality of spray nozzles disposed on said inner wall of said central razor cleaning cavity are arranged to discharge water into said central razor cleaning cavity so as to clean the one or more blades in the head of the razor positioned therein.

4. The shower head having a razor cleaning cavity as recited in claim 1 wherein each of said plurality of spray nozzles disposed on said inner wall of said central razor cleaning cavity are arranged substantially perpendicular to said inner wall and positioned to discharge water towards one other into said central razor cleaning cavity so as to clean the one or more blades in the head of the razor positioned in said central razor cleaning cavity.

5. The shower head having a razor cleaning cavity as recited in claim 1 wherein said diverter valve assembly is selectively operable into a first position such that it prevents water from flowing through said first peripheral channel and out from said plurality of spray nozzles disposed on said front surface of said spray head.

6. The shower head having a razor cleaning cavity as recited in claim 1 wherein said diverter valve assembly is selectively operable into a first position such that it allows water to flow through said second peripheral channel and out from said plurality of spray nozzles disposed on said inner wall of said central razor cleaning cavity.

7. The shower head having a razor cleaning cavity as recited in claim 1 wherein said diverter valve assembly is selectively operable into a second position such that it prevents water from flowing through said second peripheral channel and out from said plurality of spray nozzles disposed on said inner wall of said central razor cleaning cavity.

8. The shower head having a razor cleaning cavity as recited in claim 1 wherein said diverter valve assembly is selectively operable into a second position such that it allows water to flow through first peripheral channel and out from said plurality of spray nozzles disposed on said front surface of said spray head.

9. The shower head having a razor cleaning cavity as recited in claim 1 further comprising a holding bracket having a water inlet disposed in fluid communication with a water delivery fixture.

10. The shower head having a razor cleaning cavity as recited in claim 9 wherein said holding bracket further includes a water outlet.

11. The shower head having a razor cleaning cavity as recited in claim 10 further comprising a water delivery conduit disposed in fluid communication between said water outlet of said holding bracket and said shower head.

12. The shower head having a razor cleaning cavity as recited in claim 1 further comprising a holding bracket having a pair of arms extending therefrom for removably retaining said handle therein.

13. The shower head having a razor cleaning cavity as recited in claim 1 wherein said handle comprises at least one grip retention member selected from the group consisting of a ridge, an indentation, a nub, and a raised surface, to facilitate retaining a grip on said handle during use.

14. A shower head having a razor cleaning cavity for cleaning one or more blades in a head of a razor, said shower head comprising:

a spray head comprising a front member having a front surface disposed around a central razor cleaning cavity which is at least partially defined by an inner wall, said central razor cleaning cavity dimensioned and configured to receive at least a portion of the head of the razor therein for cleaning;

each of said inner wall and said front surface including a plurality of holes formed there through;

a back member interconnected to said front member, said back member having at least one aperture there through disposed in fluid communication with a drain channel;

a plurality of spray nozzles each extending from a corresponding one of said plurality of holes through said front surface and said inner wall and disposed thereon, respectively;

a first peripheral channel in fluid communication with said plurality of spray nozzles on said front surface;

a second peripheral channel in fluid communication with said plurality of spray nozzles on said inner circular wall;

a handle having said spray head attached to one end thereof and including a diverter valve assembly including a first supply conduit in fluid communication with said first peripheral channel and a second supply conduit in fluid communication with said second peripheral channel; and said diverter valve assembly is selectively operable to allow water to discharge either from said plurality of spray nozzles on said front surface, or from said plurality of spray nozzles on said inner wall so as to clean the one or more blades in the head of the razor operatively positioned therein for cleaning.

15. The shower head having a razor cleaning cavity as recited in claim 14 wherein each of said plurality of spray nozzles extending from said corresponding one of said plurality of holes through said front surface of said spray head are arranged to discharge water onto a person while showering.

16. The shower head having a razor cleaning cavity as recited in claim 14 wherein each of said plurality of spray nozzles extending from said corresponding one of said plurality of holes through said inner wall of said central razor cleaning cavity are arranged to discharge water into said central razor cleaning cavity so as to clean the one or more blades in the head of the razor operatively positioned therein.

17. The shower head having a razor cleaning cavity as recited in claim 14 wherein each of said plurality of spray nozzles extending from said corresponding one of said plurality of holes through said inner wall of said central razor cleaning cavity are disposed substantially perpendicular to said inner wall and are arranged to discharge water towards one other so as to clean the one or more blades in the head of the razor operatively positioned in said central razor cleaning cavity.

18. The shower head having a razor cleaning cavity as recited in claim 14 wherein said back member further comprises a drain cover, wherein said drain cover is attached to a back surface of said back member at one end and detached from said back surface of said back member at an opposite end, thereby at least partially defining said drain channel there between.

19. The shower head having a razor cleaning cavity as recited in claim 14 wherein said diverter valve assembly is further selectively operable to allow water to discharge from both said plurality of spray nozzles on said front surface of said spray head and said plurality of spray nozzles on said inner wall.

20. A shower head having a razor cleaning cavity for cleaning one or more blades in a head of a razor, said shower head comprising:

a spray head comprising a front member including a central razor cleaning cavity having a rounded entrance perimeter and an inner circular wall, and a planar front surface surrounding said central razor cleaning cavity, said central razor cleaning cavity dimensioned and configured to receive at least a portion of the head of the razor therein for cleaning;

each of said inner circular wall and said planar front surface including a plurality of holes formed there through;

a back member including one or more apertures there through, and a drain cover disposed over said one or more apertures at least partially defining a drain channel there between;

a plurality of spray nozzles each extending from a corresponding one of said plurality of holes on said planar front surface and on said inner circular wall;

a first peripheral channel in fluid communication with said plurality of spray nozzles on said front surface;

a second peripheral channel in fluid communication with said plurality of spray nozzles on said inner circular wall;

said front member attached to said back member at least partially enclosing said first and second peripheral channels;

a handle housing a diverter valve assembly including an inlet port, a rotating diverter plate associated with a stem, a first supply conduit in fluid communication with said first peripheral channel, and a second supply conduit in fluid communication with said second peripheral channel, one end of said stem extending through a front wall of said handle and coupled to a control knob for operating said diverter plate;

said spray head attached to one end of said handle;

a water delivery conduit having one end removably attached to said inlet port and another end removably attachable to a water delivery fixture to deliver water to said shower head; and said diverter valve is selectively operated to allow water to discharge either from said plurality of spray nozzles on said front surface, or from said plurality of spray nozzles on said inner circular wall to clean the one or more blades in the head of the razor operatively positioned therein for cleaning.

* * * * *